US008469734B2

(12) United States Patent
Chen

(10) Patent No.: US 8,469,734 B2
(45) Date of Patent: Jun. 25, 2013

(54) RETAINER SYSTEM FOR ELECTRIC CABLE COUPLERS

(76) Inventor: Liang Light Chen, Los Gatos, CA (US)

( * ) Notice: Subject to any disclaimer, the term of this patent is extended or adjusted under 35 U.S.C. 154(b) by 31 days.

(21) Appl. No.: 13/066,322

(22) Filed: Apr. 12, 2011

(65) Prior Publication Data

US 2011/0256750 A1 Oct. 20, 2011

Related U.S. Application Data

(60) Provisional application No. 61/342,955, filed on Apr. 20, 2010.

(51) Int. Cl.
*H01R 13/627* (2006.01)

(52) U.S. Cl.
USPC ..... 439/353; 439/624

(58) Field of Classification Search
USPC ..... 439/351, 353, 623, 624
See application file for complete search history.

(56) References Cited

U.S. PATENT DOCUMENTS

| | | | | |
|---|---|---|---|---|
| 2,895,119 | A | 7/1959 | Montgomery, Jr. | |
| 4,113,179 | A * | 9/1978 | McKee | 439/354 |
| 5,080,603 | A * | 1/1992 | Mouissie | 439/353 |
| 5,158,473 | A * | 10/1992 | Takahashi et al. | 439/353 |
| 5,397,247 | A * | 3/1995 | Aoki et al. | 439/496 |
| 6,565,386 | B1 * | 5/2003 | Yoneyama et al. | 439/607.01 |
| 6,945,825 | B2 * | 9/2005 | Aramoto et al. | 439/680 |
| 6,979,224 | B2 * | 12/2005 | Boemmel et al. | 439/492 |
| 7,270,560 | B1 | 9/2007 | Bodmann | |
| 8,092,246 | B1 * | 1/2012 | Santiago | 439/357 |
| 2004/0092172 | A1 * | 5/2004 | Munger et al. | 439/680 |
| 2011/0256750 | A1 * | 10/2011 | Chen | 439/345 |

FOREIGN PATENT DOCUMENTS

| | | |
|---|---|---|
| DE | 196 33 933 | 4/1998 |
| EP | 1 276 177 | 1/2003 |
| EP | 1 575 134 | 9/2005 |

* cited by examiner

*Primary Examiner* — James Harvey
(74) *Attorney, Agent, or Firm* — Heisler & Associates

(57) ABSTRACT

Male and female couplers which are complementally formed to attach together are fitted with a retainer system including prongs on one of the couplers and a gap on the other of the couplers which can engage the prongs. The prong or gap is configured as either fixed or pivoting so that the pivoting portion can pivot to engage the fixed portion. When the male coupler is inserted into the female coupler, the prongs and gaps engage each other. To remove the male coupler from the female coupler, a pivoting portion must be pivoted to move the gap and prongs away from each other. The gap is configured as an at least partial recess into which the prong is received. The prongs and loop or slit are coupled to the male and female coupler ends through removably attachable male and female retainers or built directly into the female and male coupler.

6 Claims, 7 Drawing Sheets

RETAINER SYSTEM FOR ELECTRIC CABLE COUPLERS

CROSS-REFERENCE TO RELATED APPLICATIONS

This application claims benefit under Title 35, United States Code §119(e) of U.S. Provisional Application No. 61/342,955 filed on Apr. 20, 2010.

FIELD OF THE INVENTION

The following invention relates to couplers for the ends of electric power cables and cords which include a retainer feature to hold two complemental couplers together.

BACKGROUND OF THE INVENTION

Electric cables are often used with computer equipment or other appliances or other equipment that either runs off of electric power received through an electric power cable or which requires the transfer of signals along cables passing into or out of an electrically powered device. Such cables have a variety of different configurations to provide the required interconnections for transfer of power or signals into or out of such devices. The ends of such cables can generally be referred to as couplers. These couplers generally come in complemental male and female counterparts. The male counterpart is configured to fit within the female counterpart and to provide an appropriate electrical coupling therethrough.

Examples of such "appliance couplers" are included herein in FIGS. 4-25 and 30-41, and generally are configured according to IEC international standard 60320-1 and 60320-2. One general feature of such couplers is that the male coupler has a plug mass which fits within the female coupler's complementally shaped recess. This plug mass typically has multiple substantially planar facets oriented and sized complementally with corresponding facets on the sides of the recess within the female coupler. The plug mass also includes holes therein which receive electrically conductive prongs extending up into the recess of the female coupler. In some instances, the distinction between male and female couplers is blurred, but in each case pairs of complementally formed couplers are provided which engage each other and facilitate transfer of power and/or an electric signal therethrough.

One problem with such couplers is that the plug mass of the male coupler fits within the female recess with some clearance space to facilitate the insertion of the male plug mass into the female recess. This clearance allows the couplers to be joined together relatively easily, but also can relatively easily allow for removal of the male coupler from the female coupler. In many environments and situations it is critical that the electrical appliance remain electrically coupled through the electric cable and the complemental male and female couplers.

For instance, medical devices in an operating room or intensive care unit must often remain powered to continue functioning during critical times, such as during an operation on a patient. Also, in data centers where it is critical that electrical equipment remain properly running continuously, it is essential that such electrical equipment not become "unplugged." The clearance which allows the male coupler plug mass to fit within the recess in the female coupler creates the potential for inadvertent decoupling and "unplugging" to occur. Accordingly, a need exists for a simple but effective system to ensure that the male coupler remains securely attached to the female coupler.

SUMMARY OF THE INVENTION

With this invention, a retainer system is provided which can either be incorporated into the geometry of the couplers themselves or be attached to the couplers, with the end result being secure retainment of the male coupler to the female coupler. When retrofitting the retainer system to existing couplers, a separate male coupler retainer and female coupler retainer are provided, with the male coupler retainer attachable to a male coupler plug mass and with the female retainer attachable to the female coupler.

In one such retrofit style retainer system, the female coupler already includes a face with screw receiving holes passing therethrough and with a recess within which prongs extend. With this invention a female retainer is provided which is attachable to the female coupler. The female retainer has a plate with a similar perimeter size to the face of the female coupler. Screw holes are also provided in the plate which align with the screw holes in the face of the female coupler. Thus, when appropriate screws pass through the holes in the plate of the female retainer and in the face of the female coupler, the female retainer is securely attached to the female coupler. An opening in the female retainer aligns with the recess so that the male coupler plug mass can pass through the opening in the female retainer and on into the recess of the female coupler to provide the electrical connection between the male coupler and the female coupler.

To function according to this invention, the female retainer includes a collar surrounding the opening and extending away from the plate. This collar includes prongs extending radially from sides of the collar. These prongs engage with the male retainer structures attachable to the male coupler to complete the retainer system of this invention.

In particular and according to one embodiment, the male retainer comes in the form of a pair of retainer halves which are attachable together in a manner surrounding the male coupler. The male coupler includes a plug mass at a distal end thereof which passes through the opening in the female retainer and into the recess of the female coupler. A neck is provided on a side of the male coupler opposite the plug mass. The retainer halves of the male retainer take advantage of this neck on the male coupler so that the retainer halves, when coupled together, remain attached to the male coupler. Interior structures within the shell halves of the male retainer are preferably complemental to contours of the male coupler adjacent this neck portion of the male coupler. Each shell half includes prong engagement structures which allow the shell halves to be connected together. Once connected, the shell halves of the male retainer remain secured to the male coupler.

To function according to this embodiment, each of the shell halves of the male retainer include a lever and loop extending laterally away from remaining portions of the shell halves of the male retainer. This lever and loop structure is capable of pivoting (along arrow C of FIGS. 2 and 3). The loops on these male retainers are positioned and sized to receive the prongs of the female retainer therein. The loops form are optional for the prong engagement structure, but other prong engagement structures could be provided on the male retainer portions, which at a minimum provide an element which the prong engages to secure the prong of the female retainer to the male retainer.

Preferably, the prongs have a beveled tip and are positioned relative to the loops so that merely pressing the male coupler into the female coupler (when the male retainer is attached to the male coupler and the female retainer is attached to the female coupler), causes the loops to pass over the prongs and "snap" past the prongs with the prongs residing within the loops. Once so snapped in place, the beveled surfaces on the prongs prevent removal of the loops off of the prongs, so that the male coupler remains securely attached to the female coupler. When removal of the male coupler from the female coupler is desired, forces can be applied to the levers on the male retainer so that the loops pivot (about arrow C) off of the prongs of the female retainer. The male coupler can then be removed from the female coupler. Inadvertent bumping or tugging on the male coupler or the cord associated with the male coupler will not be sufficient to inadvertently "unplug" the male coupler from the female coupler.

In an alternative embodiment, the plug mass of the male coupler and the recess within the female coupler are provided with a polygonal shape other than rectangular. In such embodiments, the female retainer can be appropriately modified and the male retainer shell halves can be appropriately modified to be attachable to such alternative female couplers and male couplers. Thus, the retainer system of this invention can be adapted in alternative embodiments to various different polygonal shapes. A representative depiction of some such shapes is provided in FIGS. 4-25. Other shapes could also be involved.

Beneficially with this invention, the female coupler and male coupler do not need to be modified in any way. Because the male coupler and female coupler are not being modified, but rather only a separate retainer system including a female retainer and a male retainer are provided, and these retainer system portions do not require permanent attachment to the male coupler and the female coupler, compliance with safety standards and testing laboratory standards is facilitated. Furthermore, it is not required that existing female coupler and male coupler geometries be modified to have the retainer system of this invention work effectively. Rather, the male coupler and female coupler are merely retrofitted with the male retainer and female retainer structures to facilitate function according to this invention.

As an alternative, in another embodiment of this invention, the couplers can be modified upon original manufacture to include retainer structures similar to those described above. Generally speaking, such new plug designs can merely be similar to those depicted above except that where the female retainer and male retainer shell halves are shown as separate structures, they would be incorporated into the female coupler and male coupler. Such an alternative is depicted in FIGS. 26-29 and could be modified to work with couplers including those shown in FIGS. 30-41.

In particular, the female coupler is merely fitted with slits or other prong engagement structures into which prongs on flexible ears located on a side of the male retainer can extend. These ears are biased to extend slightly laterally from the male coupler plug mass. When the male coupler plug mass is inserted into a groove of the female coupler, the prongs on the ears "snap" into the slits or past other prong engagement structures to retain the male coupler to the female coupler until intentional release by compressing the ears.

OBJECTS OF THE INVENTION

Accordingly, a primary object of the present invention is to provide a retainer system to prevent inadvertent de-coupling of electric cable couplers from each other.

Another object of the present invention is to provide a method for securing electric couplers at terminal ends of electric cables together in a secure and reliable fashion.

Another object of the present invention is to provide a system for preventing the inadvertent disruption of electric power to an appliance by inadvertent "unplugging" of a power cord of the electric appliance.

Another object of the present invention is to provide a system for retrofitting onto existing male and female electric couplers which cause the couplers to be secured to each other when the male coupler is inserted into the female coupler.

Another object of the present invention is to provide a retainer system for terminal ends of electric cables which are built into male and female coupler ends.

Another object of the present invention is to provide an electric cable coupling system which can more readily have a male coupler thereof inserted into a female coupler thereof than the male coupler can be removed from the female coupler.

Another object of the present invention is to provide a retainer system for terminal ends of electric couplers which retainer system can work with a variety of different styles of male and female coupler ends.

Other further objects of the present invention will become apparent from a careful reading of the included drawing figures, the claims and detailed description of the invention.

DESCRIPTION OF THE PREFERRED EMBODIMENT

Figure 28:
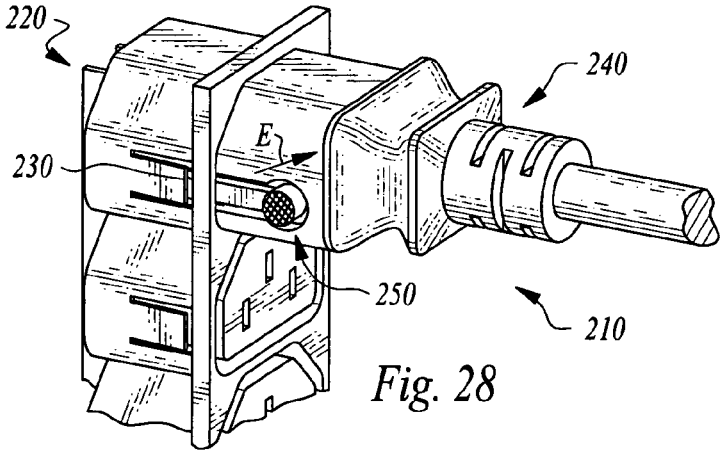
FIG. 28 is a perspective view of an alternative embodiment of that which is shown in FIG. 26 where the geometry of the female coupler and the male coupler have been modified and the female coupler is depicted as one of a series of female couplers provided as part of a common array of female couplers.
Figure 29:
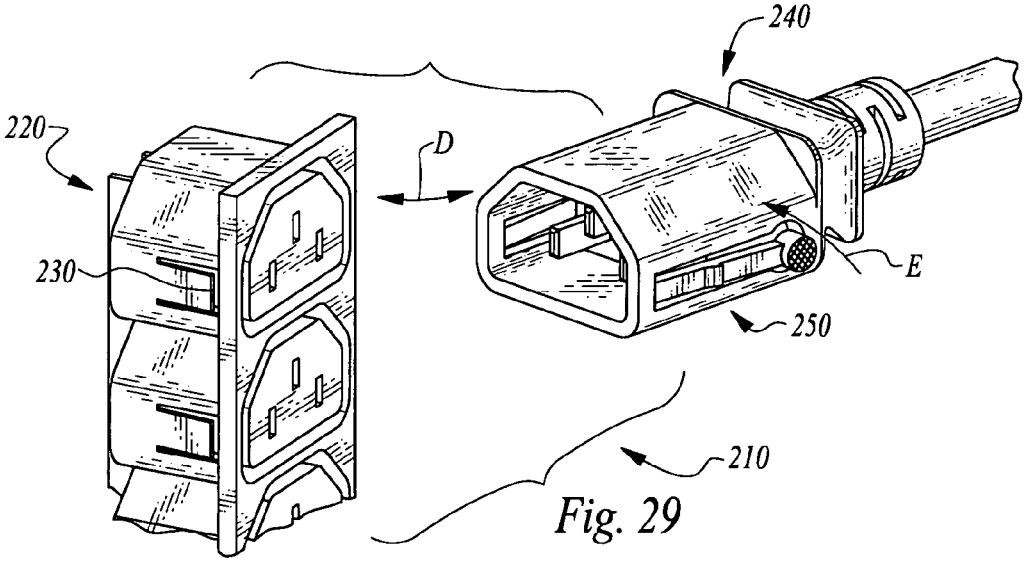
FIG. 29 is an exploded perspective view of that which is shown in FIG. 28 and further revealing details of the alternative retainer system depicted therein.
Figure 30:
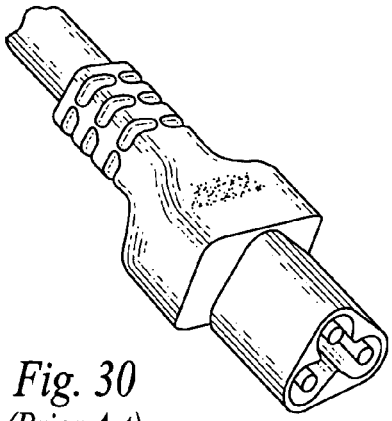
Fig. 30 (Prior Art)
FIGS. 30-41 reveal a series of male and female coupler halves of differing geometries known in the prior art which are readily capable of being modified in a manner similar to that depicted in FIGS. 26-29 to provide the alternative retainer system of this invention on such known other prior art male and female coupler end geometries. Even numbered figures depict male coupler ends which can be modified to match the geometry of these male coupler ends. Odd numbered figures depict female couplers which can be appropriately modified to conform to the geometry of corresponding male coupler ends. Consecutive figures depict male and female coupler ends of complemental form which can be connected together and which are secured together through the retainer system of this invention if modified to include the female retainer and male retainer such as those shown in FIGS. 26-29, but appropriately modified to match the geometries of FIGS. 30-41.
Figure 31:
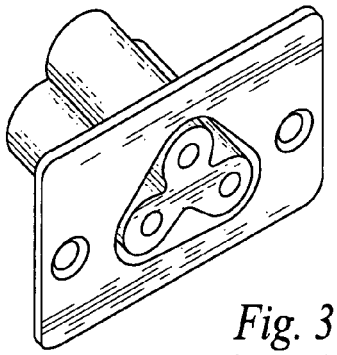
Fig. 31 (Prior Art)
Figure 32:
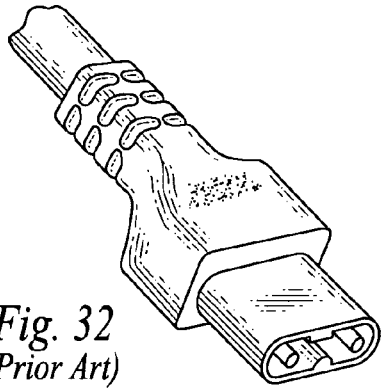
Fig. 32 (Prior Art)
Figure 33:
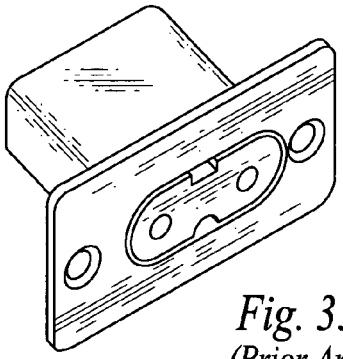
Fig. 33 (Prior Art)
Figure 34:
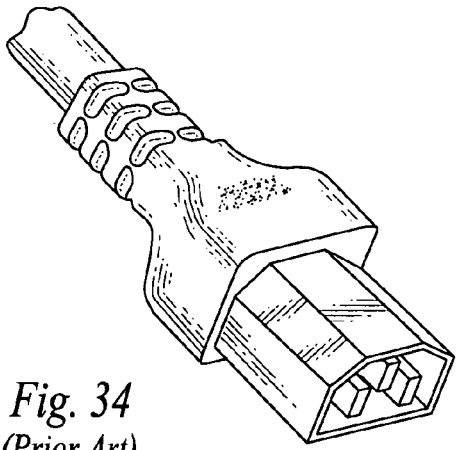
Fig. 34 (Prior Art)
Figure 35:
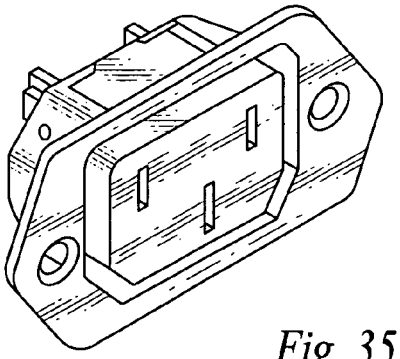
Fig. 35 (Prior Art)
Figure 36:
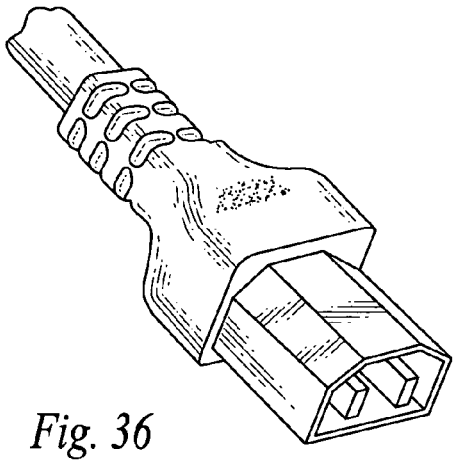
Fig. 36 (Prior Art)
Figure 37:
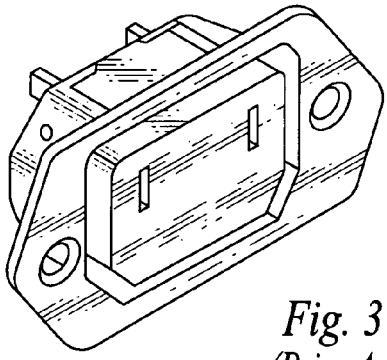
Fig. 37 (Prior Art)
Figure 38:
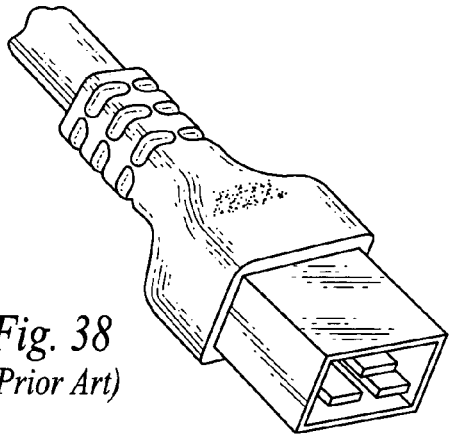
Fig. 38 (Prior Art)
Figure 39:
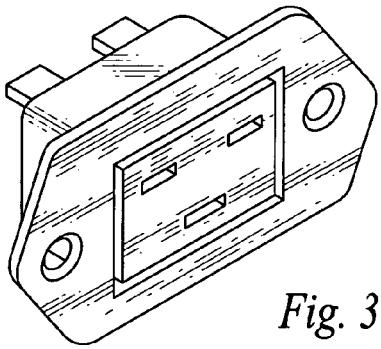
Fig. 39 (Prior Art)
Figure 40:
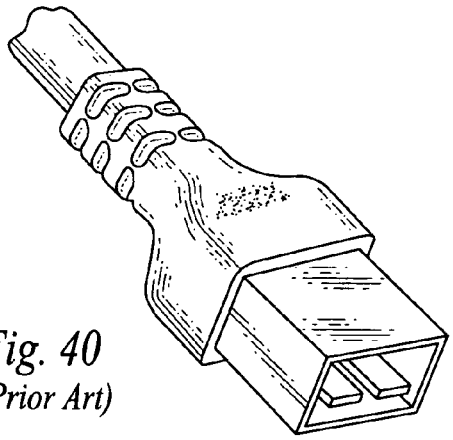
Fig. 40 (Prior Art)
Figure 41:
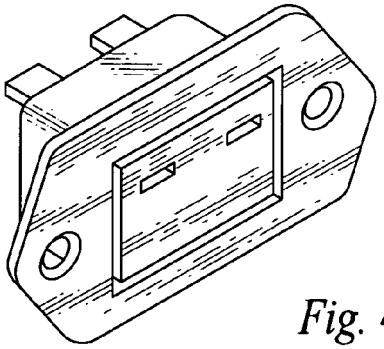
Fig. 41 (Prior Art)

Referring to the drawings, wherein like reference numerals represent like parts throughout the various drawing figures, reference numeral 10 (FIGS. 1-3) is directed to a retainer system for retaining a female coupler 20 to a male coupler 40 defining terminal ends of electric cables 42 or other electric circuitry generally commonly referred to as electric cable according to this invention. The retainer system 10 in this first embodiment (FIGS. 1-3) is configured to have retainer portions removably attachable to the female coupler 20 and male coupler 40 so that the female coupler 20 and male coupler 40 do not need to be modified to benefit from the attributes of the retainer system 10 of this invention. An alternative retainer system 110 is depicted as well (FIGS. 26 and 27) where the retainer system 110 is built into the female coupler 120 and male coupler 140. A slightly modified second alternative retainer system 210 is also depicted exhibiting a different geometry from that of the retainer system 110 (FIGS. 28 and 29).

Figure 1:
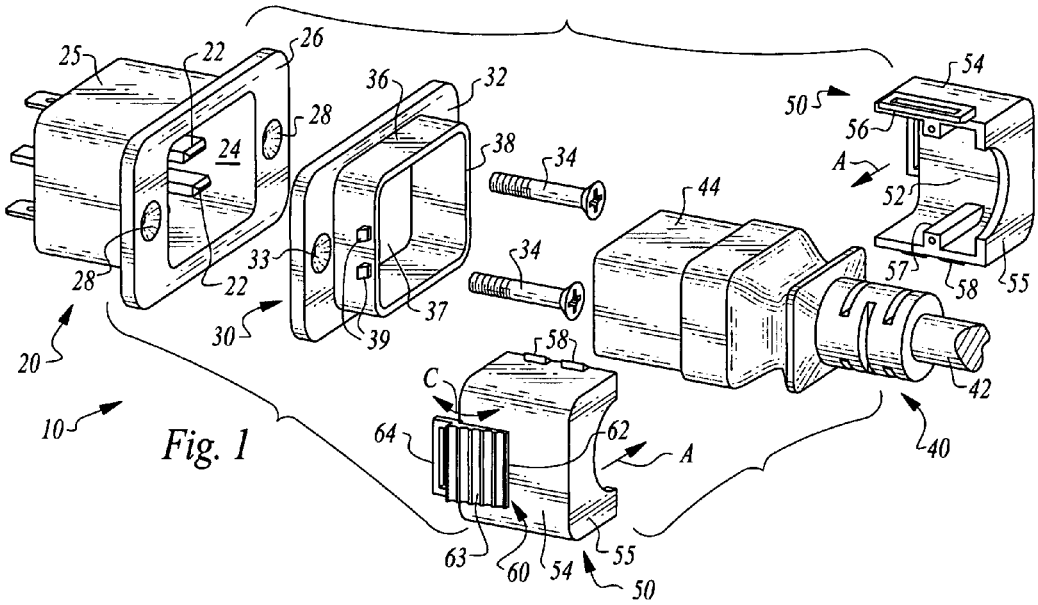
FIG. 1 is an exploded parts perspective view of a retainer system according to a first embodiment of this invention with a female retainer ready to be coupled with screws to a female coupler and a pair of male retainer halves ready to be brought together and attached to a male coupler.
Figure 2:
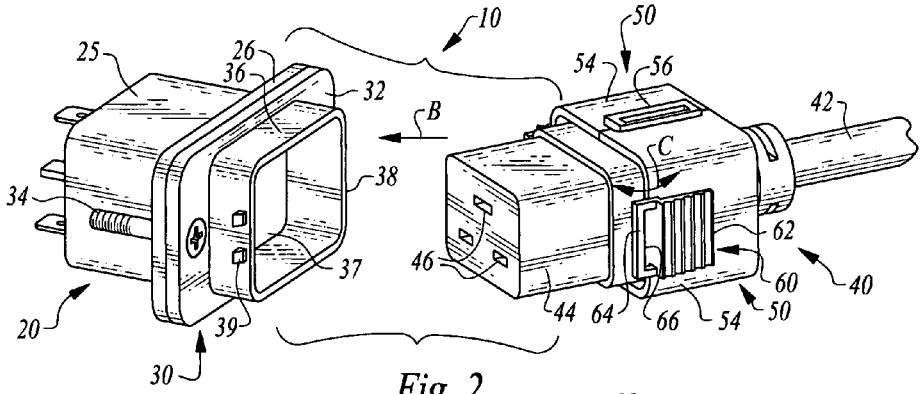
FIG. 2 is a perspective view of the retainer system of FIG. 1 with the female retainer secured to the female coupler and the male retainer halves secured to the male coupler.
Figure 3:
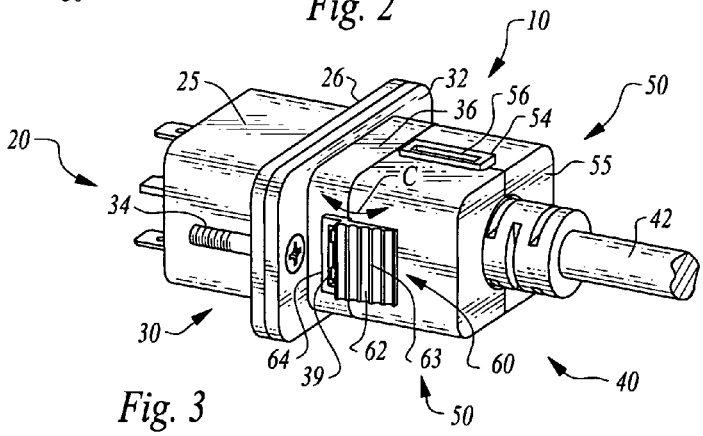
FIG. 3 is a perspective view of the retainer system of FIGS. 1 and 2 after the male plug and associated retainer have been coupled to the female coupler and associated female retainer.
Figure 4:
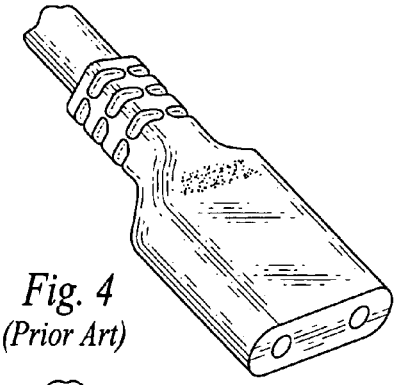
Fig. 4 (Prior Art)
FIGS. 4-25 reveal a series of male and female coupler halves of differing geometries known in the prior art which are readily capable of being modified in a manner similar to that depicted in FIGS. 1-3 to provide the retainer system of this invention on such known other prior art male and female coupler end geometries. Even numbered figures depict male coupler ends which can have male retainer halves modified to match the geometry of these male coupler ends. Odd numbered figures depict female couplers which can have a female retainer of appropriately modified geometry secured thereto. Consecutive figures depict male and female coupler ends of complemental form which can be connected together and which are secured together through the retainer system of this invention if modified to include the female retainer and male coupler halves such as those shown in FIGS. 1-3, but appropriately modified to match the geometries of FIGS. 4-25.
Figure 5:
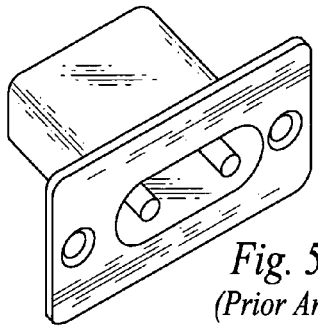
Fig. 5 (Prior Art)
Figure 6:
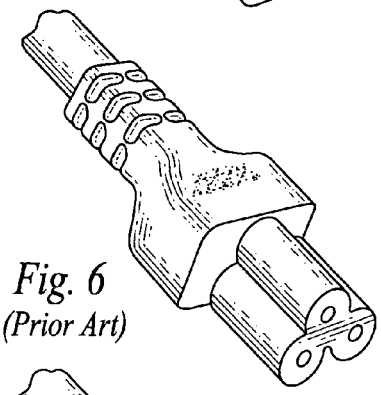
Fig. 6 (Prior Art)
Figure 7:
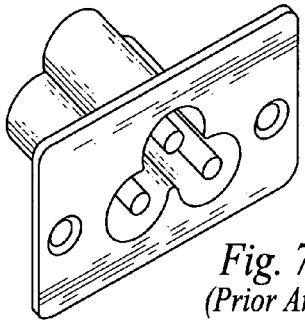
Fig. 7 (Prior Art)
Figure 8:
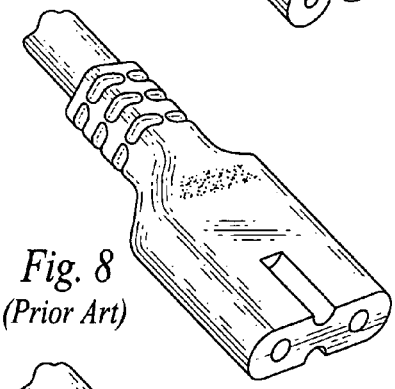
Fig. 8 (Prior Art)
Figure 9:
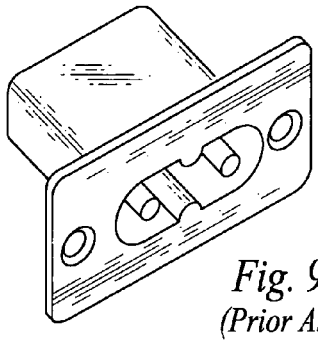
Fig. 9 (Prior Art)
Figure 10:
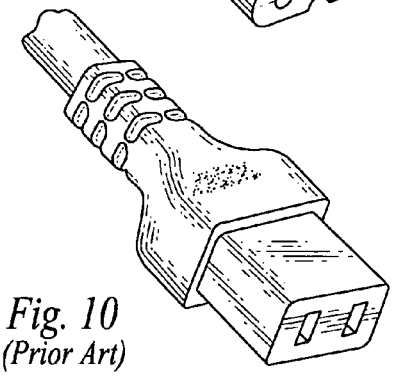
Fig. 10 (Prior Art)
Figure 11:
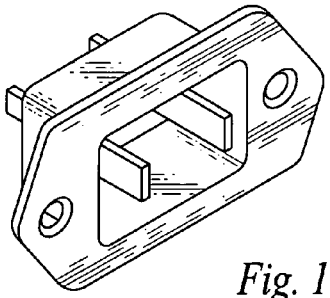
Fig. 11 (Prior Art)
Figure 12:
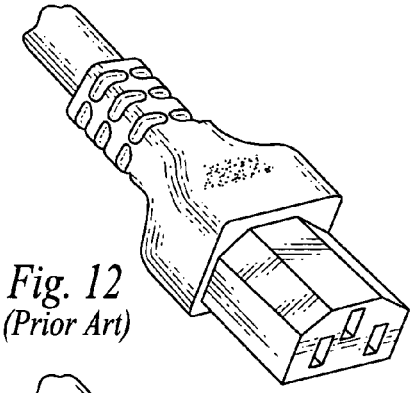
Fig. 12 (Prior Art)
Figure 13:
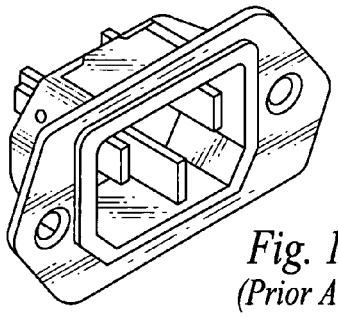
Fig. 13 (Prior Art)
Figure 14:
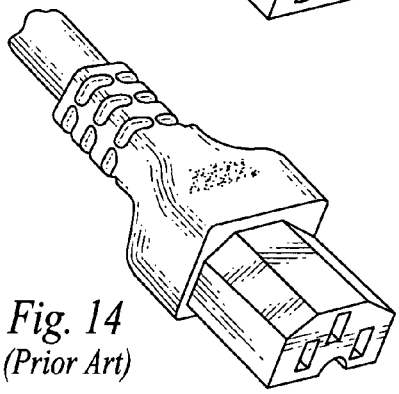
Fig. 14 (Prior Art)
Figure 15:
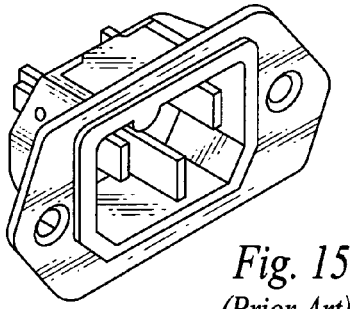
Fig. 15 (Prior Art)
Figure 16:
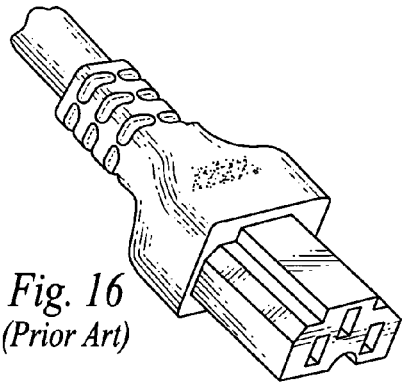
Fig. 16 (Prior Art)
Figure 17:
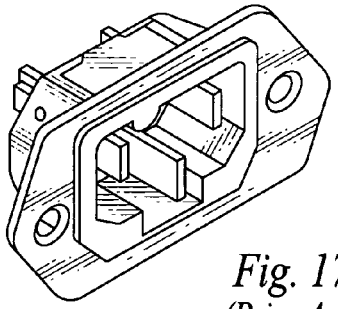
Fig. 17 (Prior Art)
Figure 18:
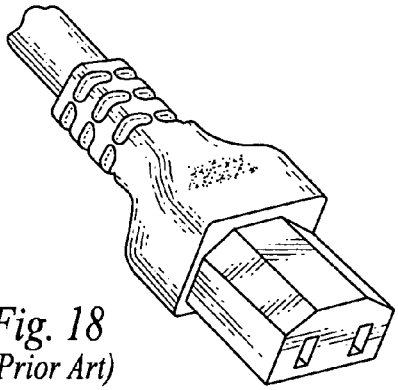
Fig. 18 (Prior Art)
Figure 19:
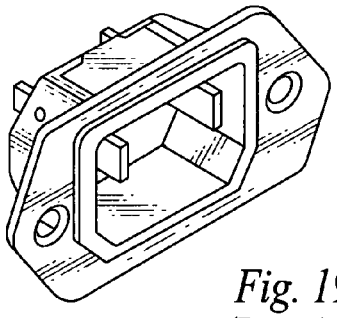
Fig. 19 (Prior Art)
Figure 20:
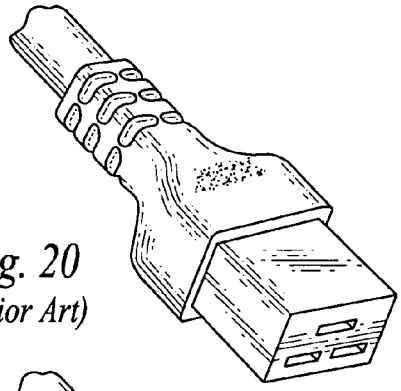
Fig. 20 (Prior Art)
Figure 21:
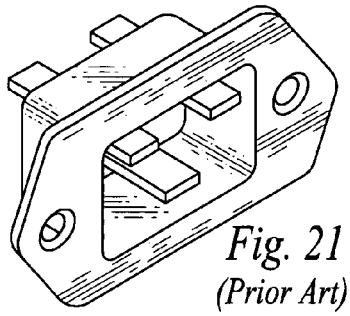
Fig. 21 (Prior Art)
Figure 22:
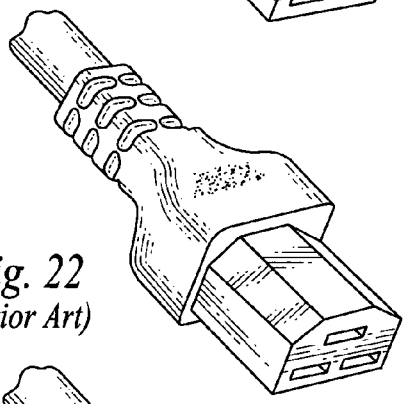
Fig. 22 (Prior Art)
Figure 23:
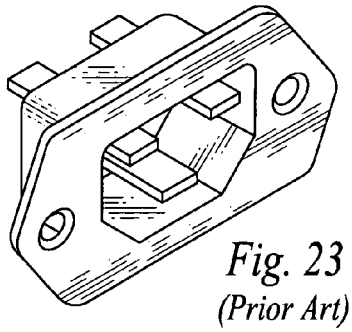
Fig. 23 (Prior Art)
Figure 24:
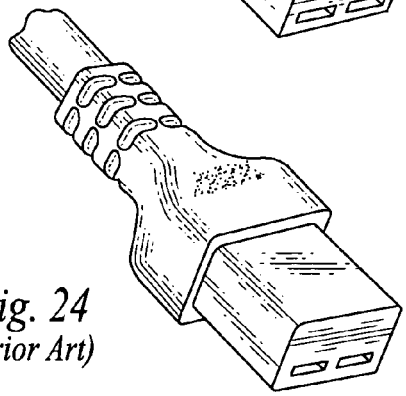
Fig. 24 (Prior Art)
Figure 25:
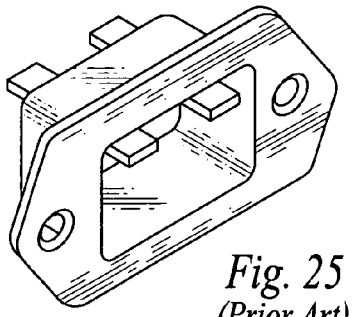
Fig. 25 (Prior Art)

With particular reference to FIGS. 1-3, basic details of the retainer system 10 are described, according to a first embodiment. A female coupler 20 is provided which can be any of a variety of different geometric shapes of female couplers. A common feature of the female couplers 20 is the inclusion of a face 26 with a recess 24 extending into the face 26 and with conductors 22 extending within this recess 24. A female retainer 30 is provided which is attachable to the female coupler 20. This female retainer 30 includes a plate 32 which joins to the face 26 and a collar 36 extending from the plate 32 and surrounding the recess 24. Prongs 39 extend from the collar 36.

The female retainer 30 is a separate structure from the female coupler 20 in this embodiment. As an alternative, the female retainer 30 could be permanently affixed to the female coupler 20 or manufactured as part of the female coupler 20. For instance, moulding of the coupler 20 could include moulding of features shown on the retainer 30.

A male coupler 40 is provided which can have any of a variety of different configurations for the male coupler 40, but complemental to the geometry of the female coupler 20. The male coupler 40 generally includes a plug mass 44 with ports 46 therein configured to receive the conductors 22 of the female coupler 20. A pair of male retainer halves 50 are provided with a geometry complemental to the plug mass 44 of the male coupler 40. These male retainer halves 50 are preferably similar in form and configured so that they can attach to each other and capture the male coupler 40 therebetween. The male retainer halves 50 also include a gap such as in the form of a pair of ears with loops thereon with the ears pivotably attached to the male retainer halves so that the loops can selectively engage the prongs 39 of the female retainer 30.

In the alternative retainer system 110 the female coupler 120 is merely provided with a slit 130 strategically located and the male coupler 140 is provided with built-in ears 150 having prongs thereon which can selectively engage the slit 130 when the ears 150 are pivoted. The second alternative retainer system 210 operates similarly to the first alternative retainer system 110, except that a different geometry is provided for the couplers 120, 140 and the alternative female coupler 220 is configured as an array of similar female couplers and with slits 230 which are provided as a portion of a coupling system for coupling the array of female couplers 220 to a mounting location.

More specifically, and with continuing reference to FIGS. 1-3, specific details of the retainer system 10 are described according to a first embodiment. The female coupler 20 includes a body 25 having conductors 22 embedded therein. At least two conductors 22 are typically provided, and most often three conductors 22 are provided. These conductors 22 are typically formed of a metal and reside within a recess 24 extending into a face 26. This recess 24 is often generally rectangular in cross-section and the conductors 22 extend within this recess 24 stopping just short of a plane in which the face 26 is oriented.

Mount holes 28 are provided on portions of the face 26 extending laterally away from the recess 24. These mount holes 28 allow for attachment of the female coupler 20 to a mount location. These mount holes 28 are also utilized for coupling of the female retainer 30 to the female coupler 20. This female coupler 20 is generally described as being located at the terminal end of an electric cable. This electric cable does not necessarily involve a freely movable cord such as an extension cord. Rather, this cable could be such a freely movable extension cord or it could be electric cabling within a fixed structure, such as electric cabling within walls of a residence or electric cabling within a rack to which electric power utilizing appliances are mounted. Thus, the term electric cable is broadly defined as any elongate electric power or electric signal carrying structure.

The female retainer 30 is a rigid structure, typically formed from injection moldable plastic, but optionally formed of any of a variety of different materials. The female retainer 30 generally includes a plate 32 which preferably has a size and shape similar to that of the face 26. Bores 33 pass through the plate 32 at locations aligned with the mount holes 28 in the face 26. Screws 34 can thus be utilized passing through the bores 33 to secure the female retainer 30 to the female coupler 20. The screws 34 also can provide the secondary function of securing the female coupler 20 to a mounting structure.

The female retainer 30 includes a collar 36 which surrounds the recess 24. This collar 36 extends perpendicularly away from the plate 32 and has a cross-sectional form similar to a cross-sectional form of the recess 24. Thus, the male coupler 40 can pass through the collar 36 on its way toward the recess 24 in the female coupler 20. The collar 36 extends out to a rim 38 with the collar 36 surrounding a central opening 37. The central opening 37 acts as an extension of the recess 24.

Prongs 39 extend from an outer surface of a collar 36 adjacent the rim 38. These prongs 39 could in a simplest embodiment be merely a single prong. However, most preferably a pair of prongs 39 are provided on each shortest lateral side of the collar 36. These prongs 39 have a tapering tip which causes the loop 64 or other prong engagement structure on the ears 60 of the male retainer halves 50 (described in detail below) to more readily pass over the prongs 39 when the male coupler 40 is inserted into the female coupler 20, than for the prongs 39 to disengage this loop 64. Thus, one can readily snap the male coupler 40 into the female coupler 20, however the male coupler 40 cannot be readily removed from the female coupler 20. Such a coupling arrangement is desirable in that it is generally desirably to be able to plug in an appliance easily and rapidly, but often undesirable to have an appliance be too easily "unplugged" in that such unplugging can be inadvertent and cause disruption of power to the appliance at a time when such unpowering of the appliance is not desired (such as when the appliance is in operation and performing important or critical functions).

The male coupler 40 is preferably a substantially rigid mass of material which typically has a cord 42 extending from one end thereof and a plug mass 44 at a terminal end thereof. Ports 46 are formed in the plug mass 44 which can receive the conductors 22 therein. When the couplers 20, 40 are engaged together (along arrow B of FIG. 2) While this particular style of male coupler 40 is complemental to the female coupler 20, the conductors 22 of the female coupler 20 could be provided on the male coupler 40 with ports 46 of the male coupler 40 alternatively provided on the female coupler 20. Also, geometry of the plug mass 44 is complemental to that of the recess 24, but the plug mass 44 and recess 24 could have a variety of different geometries such as those depicted in FIGS. 4-25. The ports 46 are provided on a face of the male coupler 40 opposite the cord 42. This plug mass 44 can pass through the central opening 37 in the collar 36 of the female retainer 30 and on into the recess 24 of the female coupler 20.

The male retainer halves 50 (depicted separately in FIG. 1 and coupled together in FIGS. 2 and 3) act as a preferred form of male retainer for coupling to the female retainer 30. Each of these male retainer halves 50 are preferably similar in form and configured so that they can be secured by motion along arrow A (FIG. 1) to each other and with the male coupler 40 captured therebetween. Each male retainer half 50 includes a central cavity 52 surrounded by side walls 54 on three sides and with a rear wall 55 on a side thereof with a hole half to allow the cord 42 of the male coupler 40 to pass therethrough.

Each sidewall 54 terminates at an edge which is designed to abut an edge of a second retainer half 50. Some of the edges are fitted with teeth 58 while other edges are fitted with a clasp 56. The clasp 56 and teeth 58 engage each other to allow the retainer halves 50 to grip each other when snapped together over a male coupler 40. Ribs 57 within the central cavity 52 of each retainer half 50 help to keep the male retainer halves 50 precisely aligned relative to the male coupler 40, rather than allowing them to flop around undesirably.

Each male retainer half 50 preferably includes an ear 60 thereon. Each ear 60 has a pivot 66 extending laterally away from a portion of a side wall 54 of a male retainer half 50. This pivot 66 terminates at a midpoint between a lever 62 and a loop 64. An outer surface 63 of the lever 62 is fitted with grooves or other tactile enhancers to allow for easy gripping of the lever 52 by fingers of a user. By providing the lever 62 on a side of the pivot 66 opposite the loop 64, when the lever 62 is depressed, the loop 64 pivots away from the male coupler 40.

The loop 64 is configured according to this depicted embodiment as a preferred form of prong 39 engagement structure, so that it engages the prongs 39 on the female retainer 30. Other forms of prong 39 engagement structures or other prong engagement means could alternatively be provided. For instance, instead of a full hole, merely a recess could be provided with a ledge that the prong 39 can engage with. The prong 39 requires at least a small gap within the loop 64 or within a recess or within some other engagement structure so that the prong 39 can move into this gap and find purchase against male retainer portions which resist prong 39 removal. Such a gap could also be provided by configuring the male retainer to itself include a prong that faces the prong 39 so that the prong 39 of the female retainer engages and snaps past such a prong on the male retainer. With such a male retainer prong, the gap would be the relief space just past the tip of the male retainer prong.

With the embodiment illustrated herein, when the levers 62 of each retainer half 60 are pressed toward each other (along arrow C of FIGS. 2 and 3), the loops 64 (or other prong 39 engagement structure) are displaced away from the male retainer halves 50 and allow for removal of the male coupler 40 from the female coupler 20. Note that the male coupler 40 is securely held within the female coupler 20 unless a user precisely grips the male coupler 40 so that fingers of the user engage the levers 62. Only when such levers 62 are engaged and depressed can the male coupler 40 be removed from the female coupler 20. Thus, the retainer system 10 is provided which resists unplugging of the male coupler 40 from the female coupler 20, except when a user intentionally grips the male coupler 40 and intentionally depresses the levers 62 of the ears 60 to allow the loops 64 of the ears 60 be freed of the prongs 39 of the female retainer 30.

With particular reference to FIGS. 4-25, a variety of prior art female couplers and male couplers are depicted which are complemental to each other. Each of the male couplers can be fitted with male retainer halves similar to the male retainer halves 50, but modified to match the geometry of these alternative male couplers. Similarly, female retainers can be provided similar to the female retainer 30, but modified to match the geometry of the female retainers of these alternative female coupler styles. When pairs of alternative female couplers and male couplers are fitted with appropriately configured female retainers and male retainer halves, a retainer system similar to the retainer system 10 can be provided for a variety of different geometries of female couplers 20 and male couplers 40, such as those depicted in FIGS. 4-25.

Figure 26:
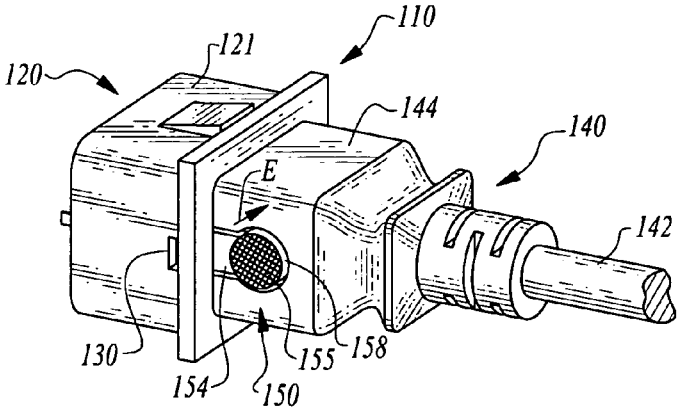
FIG. 26 is a perspective view of an alternative retainer system including a female coupler and a male coupler, with the male coupler inserted into the female coupler and with the alternative retainer system being utilized to secure the male coupler adjacent the female coupler.
Figure 27:
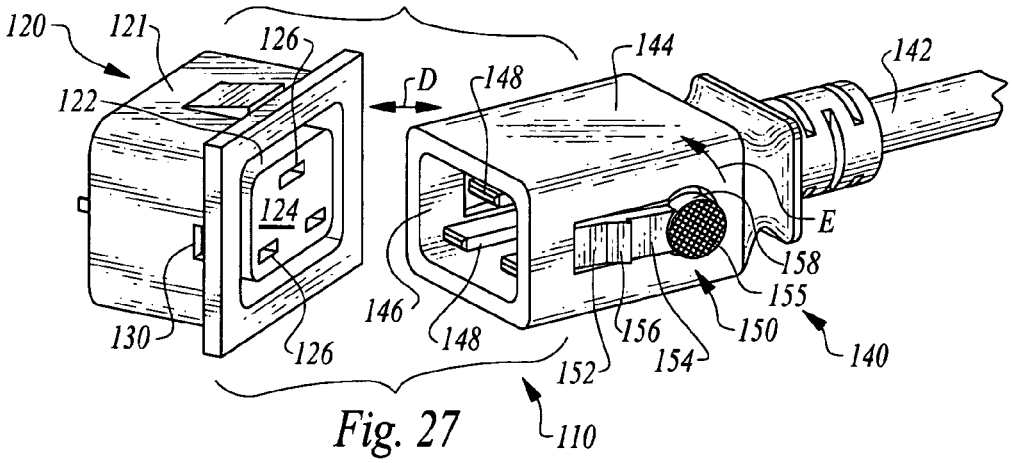
FIG. 27 is an exploded perspective view of that which is shown in FIG. 26 showing details of the alternative retainer system which cause the male coupler to be secured adjacent the female coupler when the male coupler is inserted into the female coupler.

With particular reference to FIGS. 26 and 27, details of an alternative retainer system 110 are described. With this alternative retainer system 110, a retainer system 110 is provided which is built into the couplers 120, 140 rather than being provided with separate structures attachable to existing prior art couplers 20, 40. While these couplers 120, 140 in this alternative retainer system 110 can come in a variety of different configurations, they generally include a female coupler 120 formed of a body 121. In this particular embodiment shown, a perimeter groove 122 is provided surrounding a plateau 124 which includes ports 126 extending thereinto. Importantly, a slit 130 is provided in the body 121, such as behind a face of the female coupler 120. This slit 130 provides the gap necessary for a prong 156 associated with the male coupler 140 to engage the female coupler 120 in a retained fashion. The slit 130 can extend entirely through a wall of the female coupler 120 as shown or can merely be a recess on an inner surface of this wall and either way provide the gap required for prong 156 engagement.

The male coupler 140 is provided with a complemental form to engage with the female coupler 120. In particular, a cord 142 is coupled to the male coupler 140 with a plug mass 144 at a terminal end of the male coupler 140. The plug mass 144 includes a recess 146 extending thereinto with conductors 148 extending into this recess 146. The conductors 146 are positioned to engage ports 126 in the female coupler 120. The recess 146 is sized to surround the plateau 124 so that the plug mass 144 can fit within the perimeter groove 122 of the female coupler 120.

Ears 150 are provided on the male coupler 140 which support prongs 156 that can engage this slit 130 in the female coupler 120. Each ear 150 is formed in a side of the plug mass 144 of the male coupler 140. The ears 150 reside in a gap 158 formed in the side walls of the plug mass 144. These ears 150 include a base 152 where the ears 150 attach to other portions of the plug mass 144. A tip 154 is provided at an end of each ear 150 opposite the base 152. A press pad 155 is located adjacent the tip 154 which is preferably roughened to enhance the degree with which the press pad 155 can be engaged by fingers of a user. A prong 156 is provided on each ear 150 at a point between the base 152 and the tip 154.

The ears 150 flare away from side walls of the plug mass 144 slightly before being depressed. The ears 150 are sufficiently flexible that the ears 150 can be flexed to cause them to be generally aligned with the side walls of the plug mass 144. With such biasing into a flared orientation, the ears 150 can flex inwardly (along arrow E of FIG. 27) when the male coupler 140 is inserted into the female coupler 120 (along arrow D of FIG. 27). Once attached (FIG. 28) the ears 150 can again be depressed (along arrow E of FIG. 28) and the male coupler 140 simultaneously tensioned (along arrow D of FIG. 27) for removal of the male coupler 140 from the female coupler 120. Without depression of the ears 150 of the male coupler 140, the male coupler 140 is securely retained to the female coupler 120.

In a second alternative retainer system 210 (FIGS. 28 and 29), the alternative female coupler 220 is shown which is in the form of a serial bus of multiple similar recesses for receiving separate male couplers 140. Slits 230 are provided which can merely be slits already existing in portions of the alternative female coupler 220 which allows the alternative female coupler 220 to be secured to a rack or other support structure. In such a configuration, the female coupler 220 does not require any modification to function according to this invention. Thus, both male couplers 140 which include ears 150 that can engage the slit 230 can be utilized as well as other male couplers having a similar geometry but without the ears 150 can also still be utilized, but not providing the retainer system 210 benefit of this invention. A form of enhanced compatibility of the retainer system 210 is thus provided.

Similarly, the male coupler 140 of the alternative retainer system 110 is configured so that it can be utilized both with the female coupler 120 featuring the slit 130 and also a female coupler which does not include the slit 130. While no enhanced retainment is provided, a greater degree of compatibility is provided. For instance, an appliance can be manufactured with the male coupler 140 and this appliance does not require the female coupler 120 including the slit 130 for attachment to effectively occur. Rather, an appliance can be fitted with the male coupler 140 so that if the female coupler 120 is available the retainment benefit is provided and if the female coupler 120 is not available, the appliance can still be operated, albeit without the retainer system of this invention. Similarly, the female coupler 120 can be provided with a slit 130 and still operate with male couplers which do not include ears such as the ears 150 thereon, albeit without the benefits of the retainer system 110.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. For instance, engagement structures on the male and female retainers 30, 50 can be reversed and still function according to this invention. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A retainer system for couplers at the terminal ends of a pair of electric cables, the system comprising in combination:

a coupling pair including a fixed half and a pivoting half;

said pivoting half adapted to pivot to releasably engage said fixed half;

said coupling pair including a prong and a gap, said gap sized to receive said prong within said gap, said prong attached to a first one of said coupling pair and said gap attached to a second one of said coupling pair;

one of said coupling pair attached to a first one of the pair of electric cables and one of said coupling pair attached to a second one of the pair of electric cables;

wherein said fixed half of said coupling pair includes said gap and said pivoting half of said coupling pair includes said prong;

wherein said gap includes a slit located behind a face of a female coupler of said pair of electric cables, said slit extending at least partially into a surface of said female coupler; and wherein said prong is located on an ear pivotably attached to a male coupler of said pair of electric cables, said male coupler adapted to be coupled to said female coupler with said prong engaging said gap, said ear defining part of a side wall surrounding a recess in which conductors of said male coupler are located.

2. The system of claim 1 wherein said ear pivotably attached to the male coupler includes a base pivotably attached to said male coupler and a tip on an end of said ear opposite said base, with said prong located between said base and said tip, said tip including a pad thereon of enhanced roughness for finger engagement, said ear flared out away from a side wall of a plug mass of the male coupler with said ear adapted to be deflected in toward said side wall to bring said ear coplanar with said side wall when said ear is depressed.

3. The system of claim 1 wherein said fixed half and said pivoting half of said coupling pair are each built into terminal ends of the pair of electric cables.

4. A method for securing terminal ends of an electric cable together, including the steps of:

providing a retainer system for couplers at the terminal ends of the electric cables including a coupling pair including a fixed half and a pivoting half; the pivoting half adapted to pivot to releasably engage the fixed half;

the coupling pair including a prong and a gap, the gap sized to receive the prong within the gap, the prong attached to a first one of the coupling pair and the gap attached to a second one of the coupling pair; and one of the coupling pair attached to a first one of the pair of electric cables and one of the coupling pair attached to a second one of the pair of electric cables;

configuring the terminal ends of the electric cables as a female coupler and a male coupler capable of interfacing with each other and creating an electrical connection therebetween;

inserting the male coupler into the female coupler until the prong enters the gap thereby securing the male coupler within the female coupler;

wherein said providing step includes the fixed half of the coupling pair having the gap and the pivoting half of the coupling pair having the prong;

wherein the gap includes a slit located behind a face of a female coupler of the pair of electric cables, the slit extending at least partially into a surface of the female coupler; and wherein the prong is located on an ear pivotably attached to a male coupler of the pair of electric cables, the male coupler adapted to be coupled to the female coupler with the prong engaging the gap, the ear defining part of a side wall surrounding a recess in which conductors of the male coupler are located.

5. The method of claim 4 including the further step of removing the male coupler from the female coupler by first pivoting the pivoting half relative to the fixed half to release the prong from the gap, and second applying a tension force between the male coupler and the female coupler until the male coupler has been removed from the female coupler.

6. The method of claim 4 wherein said providing step further includes the ear pivotably attached to the male coupler includes a base pivotably attached to the male coupler and a tip on an end of the ear opposite the base, with the prong located between the base and the tip, the tip including a pad thereon of enhanced roughness for finger engagement, the ear flared out away from a side wall of a plug mass of the male coupler with the ear adapted to be deflected in toward the side wall to bring the ear coplanar with the side wall when the ear is depressed.

* * * * *